US006135854A

United States Patent [19]

Masumura et al.

[11] Patent Number: 6,135,854

[45] Date of Patent: Oct. 24, 2000

[54] AUTOMATIC WORKPIECE TRANSPORT APPARATUS FOR DOUBLE-SIDE POLISHING MACHINE

[75] Inventors: Hisashi Masumura; Kiyoshi Suzuki, both of Fukushima-ken; Noboru Tamai, Nagano-ken; Syunichi Ogasawara, Gunma-ken, all of Japan

[73] Assignee: Shin-Etsu Handotai Co., Ltd., Tokyo, Japan

[21] Appl. No.: 09/233,852

[22] Filed: Jan. 19, 1999

[30] Foreign Application Priority Data

Jan. 21, 1998 [JP] Japan ..... 10-023914

[51] Int. Cl.[7] ..... B24B 7/22

[52] U.S. Cl. ..... 451/6; 451/291

[58] Field of Search ..... 451/6, 268, 269, 451/291, 9, 399, 290

[56] References Cited

U.S. PATENT DOCUMENTS 5,333,413 8/1994 Hashimoto ..... 451/9
5,679,055 10/1997 Greene et al. ..... 451/10

FOREIGN PATENT DOCUMENTS 0 547 894 6/1993 European Pat. Off. .
9187447 10/1984 Japan ..... 451/269
61-241060 10/1986 Japan .

*Primary Examiner*—Robert A. Rose
*Attorney, Agent, or Firm*—Hogan & Hartson, LLP

[57] ABSTRACT

An automatic workpiece transport apparatus for a double-side polishing machine is disclosed. A carrier is positioned at a predetermined position by a positioning unit, and an image of the top surface of the carrier is captured by use of a visual sensor. A computer performs image processing to obtain the center coordinates of the wafers or the workpiece holders while reference marks or the like provided on the carrier are used as references. The transport robot is moved and controlled based on the thus-detected coordinate data in order to load the wafers into the workpiece holders or to unload the wafers from the workpiece holders. Further, two visual sensors are provided at the tip end of the arm of the transport robot. These visual sensors send to the computer an image of the peripheral portion of the held wafer. Thus, the computer performs fine adjustment in positioning the wafer and the workpiece. The automatic workpiece transport apparatus can reliably load and unload semiconductor wafers to and from the carrier that holds semiconductor substrates.

5 Claims, 3 Drawing Sheets

AUTOMATIC WORKPIECE TRANSPORT APPARATUS FOR DOUBLE-SIDE POLISHING MACHINE

BACKGROUND OF THE INVENTION

1. Field of the Invention

The present invention relates to an automatic workpiece transport apparatus for loading and unloading workpieces such as semiconductor substrates into and from a double-side polishing machine in which both sides of the semiconductor substrates are polished simultaneously.

2. Description of the Related Art

Conventionally, a double-side polishing machine has been used for simultaneously polishing both sides of workpieces such as semiconductor substrates. In such a polishing machine, carriers each having a plurality of workpiece holders in the shape of a circular hole are in meshing engagement with a sun gear and an internal gear, and semiconductor substrates are placed in the workpiece holders. The semiconductor substrates are sandwiched between an upper and lower polishing turn tables to be held thereby, and upon rotation of the sun gear etc., the carriers cause sun-and-planet motion. Simultaneously with this, the upper and lower polishing turn tables are rotated in opposite directions in order to simultaneously polish both sides of the semiconductor substrates. Also, there has been known a method for loading and unloading workpieces into and from such carriers, e.g., a method used in an automatic surface polishing apparatus disclosed in Japanese Patent Publication Laid-Open (kokai) No. 61-241060.

In the method, loading and unloading of workpieces onto and from carriers are performed on a stage outside the polishing machine, and subsequently, a robot arm is operated to transport the carriers and workpieces together onto the polishing machine.

However, in the above-described conventional polishing apparatus, since mistakes in relation to transport of the workpieces into the carriers and transport of the carriers cannot be detected, an operator may start a polishing operation without being aware of such mistakes, resulting in generation of failed products.

SUMMARY OF THE INVENTION

In view of the foregoing, an object of the present invention is to provide an automatic workpiece transport apparatus which can reliably and smoothly load and unload workpieces into and from workpiece holders of carriers.

In order to achieve the above-described object, the present invention provides an automatic workpiece transport apparatus for a double-side polishing machine, which apparatus loads and unloads workpieces into and from workpiece holders of workpiece holding carriers that are in meshing engagement with a sun gear and an internal gear to cause sun-and-planet motion. The automatic workpiece transport apparatus comprises positioning means for positioning the carrier at a predetermined position; a visual sensor for optically recognizing a workpiece holding surface of the positioned carrier and for outputting image recognition data; and control means for image-processing the image recognition data in order to determine the positions of the workpiece holders or the workpieces and for controlling the position of a robot arm having a workpiece holding mechanism on the basis of the determined positions of the workpiece holders or the workpieces.

After the positioning means has positioned the carrier at the predetermined position, the visual sensor optically recognizes a workpiece holding surface of the positioned carrier and sends image recognition data to the control means. The control means performs image-processing on the image recognition data in order to determine the positions of the workpieces or the workpiece holders having a shape of a circular hole. The control means controls the position of a robot arm on the basis of the determined positions. By virtue of the above-described manner, the workpieces can be reliably loaded to and unloaded from a precise position, so that no trouble is caused even when all the operations from a workpiece transport operation to a polishing operation are automated.

The positioning means may be formed of a computer that outputs commands for moving the carrier and stopping the movement, a sensor that detects a specific portion of the carrier and outputs to the computer information required for stopping the movement of the carrier, and so on.

The visual sensor for optically recognizing a workpiece holding surface of the carrier may be formed of a TV camera, a semiconductor image sensor such as a CCD (charge-coupled device), or an image pickup tube such as a vidicon.

The workpiece holding mechanism of the robot arm may be a sucking/holding mechanism for sucking and holding a workpiece.

Preferably, the carrier has a reference mark that is provided in at least two locations and is used as a reference when the positions of the workpiece holders or workpieces are determined on the basis of the image recognition data.

In the present invention, accurate detection of the center coordinates of the workpiece holder or the like is enabled through use of the reference mark serving as a reference.

For such purpose, a reference mark is provided at a location offset from the center of the workpiece holder or the like by a predetermined distance and in a predetermined direction such that the position of the workpiece holder or the like can be calculated from the position of the reference mark.

In this case, further precise positions can be calculated through provision of the reference mark in at least two positions. Further, the reference mark preferably has a shape and/or color which facilitates recognition of the mark through use of the visual sensor and determination of positional coordinates.

Preferably, the robot arm for workpiece transport has at least two visual sensors that optically recognize the peripheral portion of a workpiece held by the robot arm and output image recognition data to the control means.

The control signals that are sent to the robot arm when the workpieces are loaded into the workpiece holders of the carrier are determined while the center point of the workpiece holding mechanism or the like is used as a reference point, and are not determined while the center point of a workpiece actually held is used as a reference point. Accordingly, even when the position of the workpiece holder is accurately obtained in the above-described manner, the workpiece cannot be accurately loaded into the workpiece holder if the holding position of the workpiece deviates from the theoretical position.

In order to solve this problem, when the workpiece is loaded into the workpiece holder of the carrier, an image of the peripheral portion of the workpiece is captured by the visual sensors attached to the robot arm, and image recognition data are sent to the control means. The position of the peripheral portion obtained from the image recognition data is compared with the position of the workpiece holder obtained in the above-described manner, in order to accurately load the workpiece into the workpiece holder.

In this case, if at least the two visual sensors separately control, for example, movement in the X-axis direction and movement in the Y-axis direction, smooth control is enabled.

Preferably, when the robot arm is controlled by the control means in order to remove the workpiece from the workpiece holder, the control is performed such that the workpiece holding mechanism of the robot arm holds the workpiece at a position offset from the center of the workpiece.

That is, when after completion of polishing operation the workpiece is taken out of the workpiece holder by use of the workpiece holding mechanism, such as a sucking mechanism, of the robot arm, the workpiece strongly adheres to the lower polishing turn tables or the like due to surface tension of polishing solution or the like. Therefore, if an attempt is made to lift the workpiece while sucking the center portion of the workpiece, a very large force is sometimes required.

In order to enable the workpiece to be smoothly removed with a small force, a portion of the workpiece offset from the center is held.

DETAILED DESCRIPTION OF PREFERRED EMBODIMENT

An embodiment of the present invention will be described with reference to the accompanying drawings.

The automatic workpiece transport apparatus for a double-side polishing machine according to the present invention is used with a polishing machine for polishing opposite sides of, for example, silicon wafers serving as semiconductor substrates and is designed to load wafers to be machined onto the polishing machining and unload machined wafers therefrom. The automatic workpiece transport apparatus can place wafers into workpieces holders of carriers, wherein the workpiece holders have a circular hole shape and are adapted to hold the wafers during machining. Further, the automatic workpiece transport apparatus can smoothly remove machined wafers from the workpieces holders.

Figure 3:
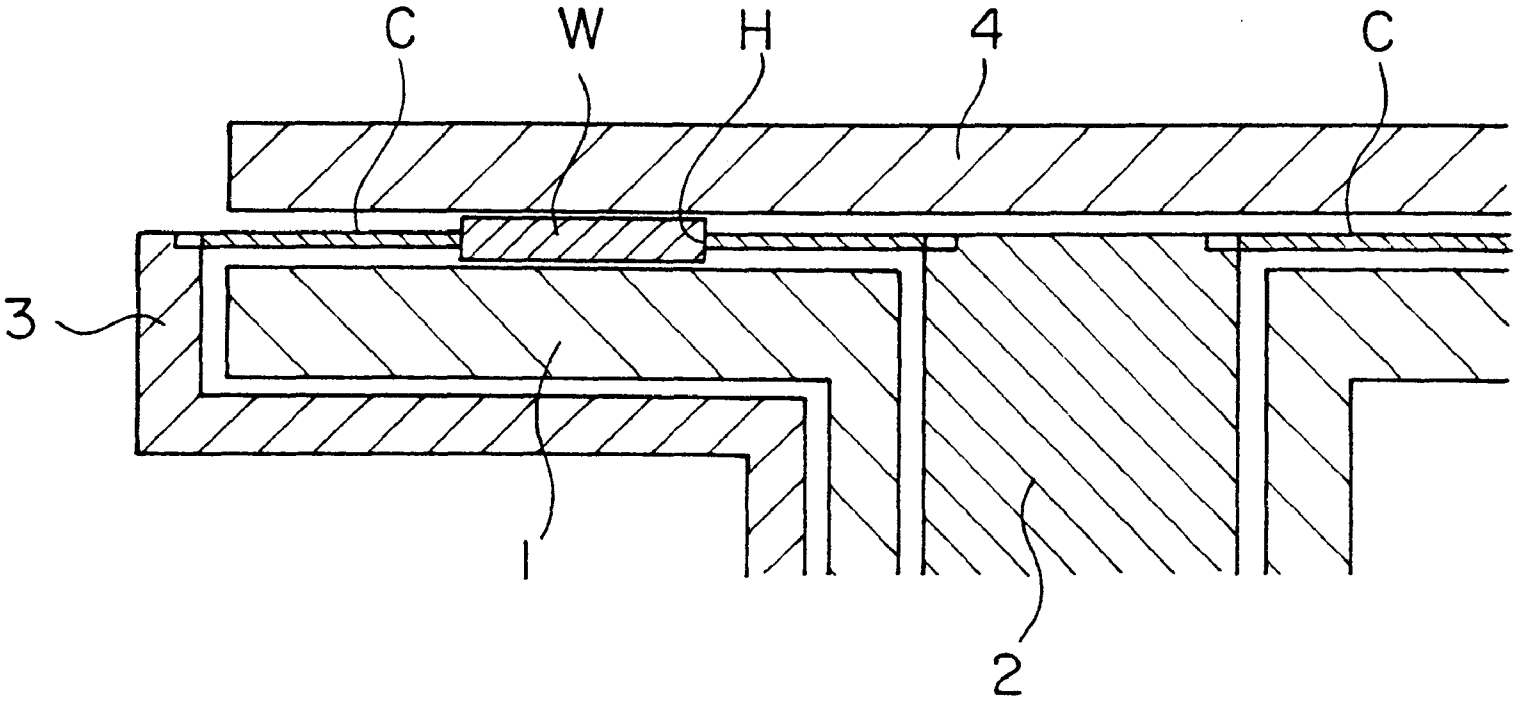
FIG. 3 is a sectional view showing an example of a double-side polishing machine.

As shown in FIG. 3, the double-side polishing machine has a sun gear 2 and an internal gear 3 that cause sun-and-planet motion of carriers C placed on a lower polishing turn table 1. Each of the carriers C has, along its peripheral portion, an external teeth for meshing engagement with the sun gear 2 and the internal gear 3. Further, within each of the carriers C are formed workpiece holders H each having a circular-hole-shape. Wafers W are fitted into the workpiece holders H to be held thereby.

Figure 2:
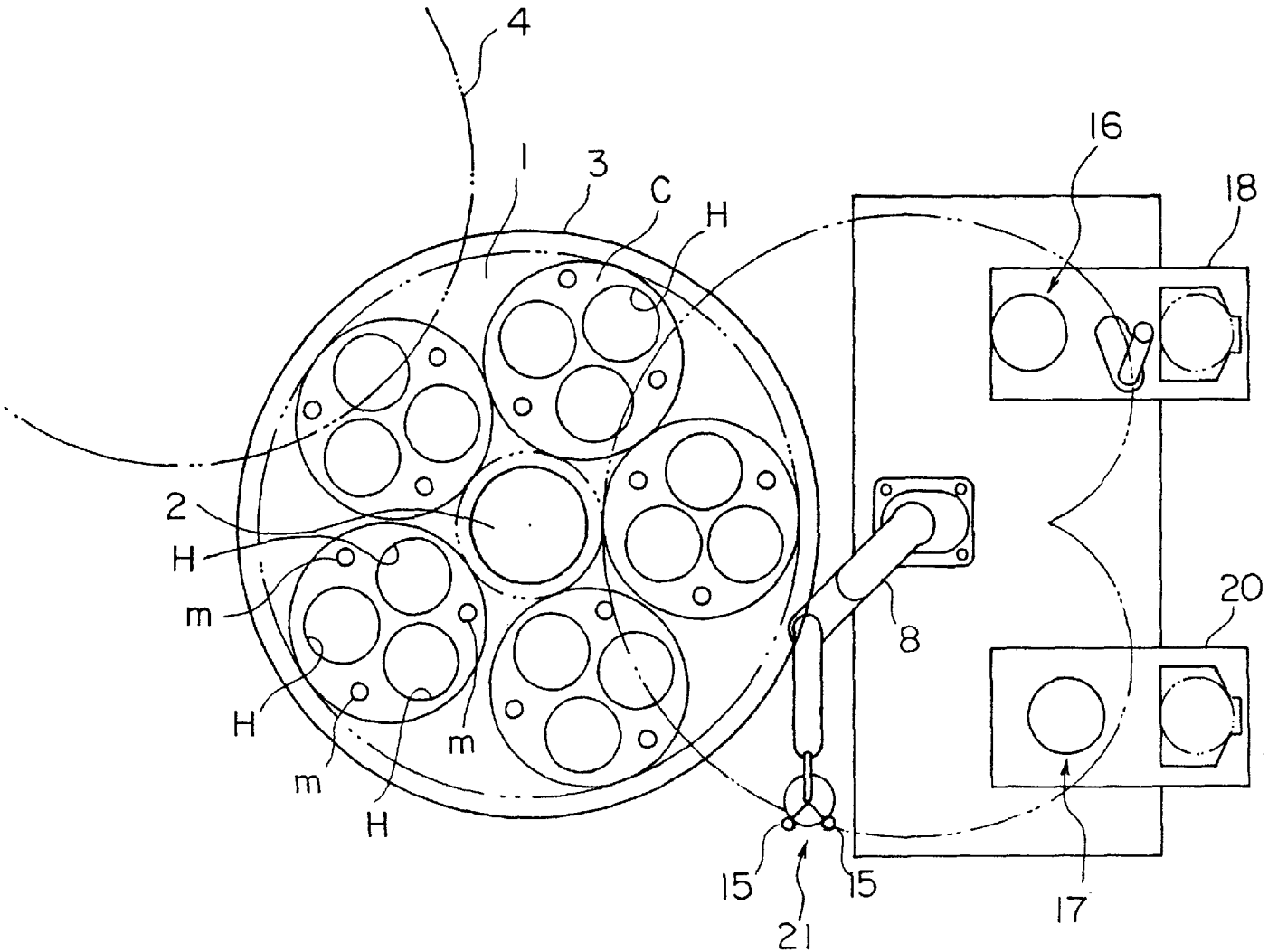
FIG. 2 is a plan view showing an example of the structure of a transport robot and neighboring portions.

As is also shown in FIG. 2, in the present embodiment, five carriers C are set such that they come into meshing engagement with the sun gear 2 and the internal gear 3 simultaneously and are supported by the lower polishing turn table 1. Every carrier C has three workpiece holders H. Wafers W are placed into the workpiece holders H of each carrier C. Subsequently, an upper polishing turn table 4—which is horizontally swingable—is swung in order to hold the wafers W between the lower and upper polishing turn tables 1 and 4. Subsequently, the sun gear 2, etc. are rotated such that the carriers C cause sun-and-planet motion. Simultaneously with this, the lower and upper polishing turn tables 1 and 4 are rotated in opposite directions, while polishing solution is supplied to the held surfaces. Thus, both sides of the wafers are polished by means of polishing pad, etc. attached to the holding-side surface of each of the polishing turn tables 1 and 4.

Figure 1:
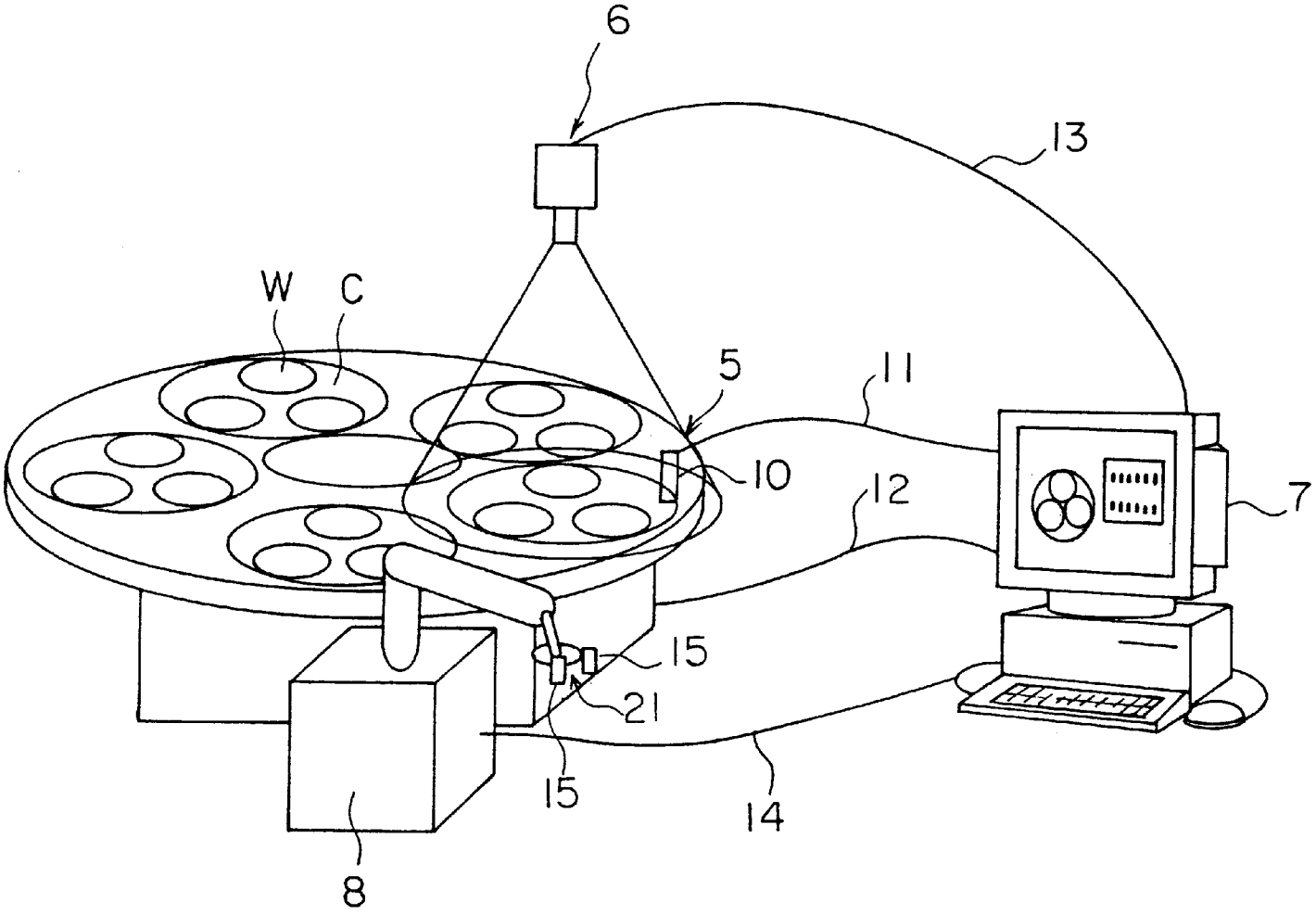
FIG. 1 is a perspective view schematically showing the structure of an automatic workpiece transport apparatus according to an embodiment of the present invention.

The automatic workpiece transport apparatus according to the present invention is constructed to load wafers W into the workpiece holders H of the carriers C of the polishing machine and to unload the wafers W from the workpiece holders H after completion of machining. As shown in FIG. 1, the automatic workpiece transport apparatus comprises positioning means 5, a visual sensor 6 such as a camera, and a computer 7 serving as control means. The positioning means 5 positions each carrier C at a predetermined position after the upper polishing turn table 4 has been retreated. The visual sensor 6 optically captures the image of the upper surface of the positioned carrier C and outputs image recognition data. The computer 7 processes the fed data in order to determine the positions of the workpiece holders H or the wafers W within the workpiece holders H, and controls a transport robot 8 based on the thus-determined positions.

The positioning means 5 has a command line 12 for transmitting a carrier moving command and a stop command, which are issued from the computer 7 to the polishing machine; a sensor 10 which is mounted on an unillustrated machine body side of the polishing machine and is adapted to detect the position of the carrier C; and an input line 11 for inputting detection signals from the sensor 10 to the computer 7. Movement of the carrier C is started in response to a command from the computer 7, which then stops the carrier C on the basis of information on the position of the carrier C as detected by the sensor 10. Thus, the carrier C can be positioned directly below the visual sensor 6.

The sensor 10 may be formed of a photoelectric sensor that utilizes emission and reception of light, eddy-current sensor and the like of non-contact types or a sensor of any other types.

The visual sensor 6 may be formed of a TV camera; a semiconductor image sensor such as a CCD (charge-coupled device), a MOS (metal oxide film semiconductor) image sensor, or a PSD (position sensitive detector); or an image pickup tube such as a vidicon. Image recognition data is input to the computer 7 via an image input line 13.

Reference marks for identifying the positions of the workpiece holders H are provided on the carriers C.

Specifically, as shown in FIG. 2, in each carrier C, three workpiece holders H having a shape of a circular hole are provided at constant angular intervals and at a fixed distance from the center of the carrier. Further, reference marks m having a shape of a small circular hole are provided at angular positions that are offset in the circumferential direction from the workpiece holders H by 60 degrees such that the reference marks m also are at a fixed distance from the center of the carrier. Accordingly, the centroid of a triangle connecting the workpiece holders H and the centroid of a triangle connecting the reference marks m are both located at the center of the carrier C, and a phase shift of 60 degrees exists between the triangles.

Therefore, when the positions of the three reference marks m are detected, the center position of the carrier C is obtained. Further, there can be easily obtained the positions of the workpiece holders H, each of which is located a predetermined distance from the center position along a line that is offset 60 degrees from the corresponding line connecting the center position and the corresponding reference mark m.

A good result can be obtained when the number of the reference marks m is two or more, and therefore, the number of the reference marks m is an arbitrary number not less than 2.

When image recognition data are input to the computer 7 via the image input line 13, the computer 7 performs a subtractive color process, etc. in order to convert the image recognition data into information suitable for subsequent image processing. The image is then matched to previously stored image information regarding the reference marks m and the like, and the positions of the workpiece holders H are determined on the basis of a mathematical calculation for obtaining the center coordinates of the workpiece holders H from the locations of the reference marks m.

The coordinates of the workpiece holders H determined from the calculation results are converted into coordinate values in the coordinate system of the transport robot 8, which are then used to control the transport robot 8 via the control line 14.

The transport robot 8 has, at the tip end of an arm thereof, a workpiece holding mechanism 21 for sucking and holding a wafer W. Further, two visual sensors 15 are attached to the tip end of the arm in the vicinity of the workpiece holding mechanism 21 such that a phase angle of 90 degrees exists between the sensors 15. The sensors 15 optically recognize portions of the peripheral surface of the held wafer W and output image recognition data to the computer 7.

When one of the wafers W is loaded into the workpiece holder H, the visual sensors 15 perform fine adjustment in an operation of positioning the peripheral portion of the wafer W relative to the inner circumferential portion of the corresponding workpiece holder H. That is, the position of the peripheral portion of the wafer W held on the robot arm of the transport robot 8 is compared with the position of the inner circumferential portion of the corresponding workpiece holder H obtained through image processing of the computer 7 in the above-described manner, in order to determine whether the two positions coincide. Subsequently, the position of the robot arm is finely adjusted on the basis of the result of the comparison.

The visual sensors 15 may be formed of a semiconductor image sensor such as CCD (charge-coupled device), a MOS (metal oxide film semiconductor) image sensor, or a PSD (position sensitive detector).

Upon receipt of the image recognition data, the computer 7 performs a subtractive color process or the like in order to convert the image recognition data into information suitable for subsequent image processing. The image is then matched to a previously prepared image of the peripheral portion of the wafer. Subsequently, the distance between the inner cicumferential portion of the workpiece holder H and the peripheral portion of the wafer W is adjusted. In order to facilitate recognition of the workpiece holder H and the wafer W, the workpiece holder H and the wafer W are preferably colored differently.

The distance between the inner cicumferential portion of the workpiece holder H and the peripheral portion of the wafer W is adjusted as follows. When the inner cicumferential portion of the workpiece holder H and the peripheral portion of the wafer W are separated from each other, the distance is treated as a positive value i.e., a value greater than zero, and when the inner cicumferential portion of the workpiece holder H and the peripheral portion of the wafer W overlap each other, the distance is treated as zero. Further, in the latter case, control is unconditionally performed through use of a predetermined negative value. That is, a distance corresponding to the negative value is converted into coordinate values in the coordinate system of the transport robot 8 in order to perform movement control of the transport robot 8.

The two visual sensors 15 are provided to correspond to the X-axis direction and Y-axis direction of the transport robot 8, so that each sensor 15 controls movement of the robot arm in respective directions.

When the value indicating the distance between the inner cicumferential portion of the workpiece holder H and the peripheral portion of the wafer W becomes positive and less than a predetermined value through the above-described small-increment movement control executed by use of the image processing, a normal signal is generated, and the processing is ended.

When the operation does not end even after the above-described small-increment movement control is repeated a predetermined number of times, there is a strong possibility that a malfunction has occurred in the apparatus. In this case, an alarm lamp provided on the automatic transport apparatus is turned on, and the operation is stopped.

The above-described control enables the wafer W to be reliably loaded into the workpiece holder H.

Further, as shown in FIG. 2, an alignment stage 16 on which a wafer W to be machined is aligned and a slope 17 for collecting a machined wafer W are provided within a movable range of the robot arm of the transport robot 8. Further, a wafer cassette 18 is provided on the upstream side of the alignment stage 16 with respect to the direction of transport, and a collection bath 20 is provided on the downstream side of the slope 17 with respect to the direction of transport.

Next, there will be described an operation of loading and unloading wafers W by use of the above-described automatic transport apparatus.

First, an operation for loading wafers W will be described. Wafers W that have been previously accommodated in a wafer cassette 18 are transported one piece at a time to the alignment stage 16 in the vicinity of the transport robot 8, where the wafer W is centered and is oriented such that an orientation flat or a notch faces a predetermined direction.

Subsequently, the transport robot 8 moves its arm from a wait position to the alignment stage 16 and sucks and holds a center portion of the wafer W through use of the workpiece holding mechanism provided at the tip end of the arm.

Meanwhile, the carrier C has been set at a predetermined position by the positioning means 5, and the positions of the workpiece holders H have been calculated based on image recognition data from the visual sensor 6.

Under control of the computer 7, the transport robot 8 transports the wafer W to a position about 1 mm above the center of a workpiece holder H.

At this position, fine adjustment is started through use of the two visual sensors 15 attached to the tip end of the robot arm. When a normal signal is sent back after the peripheral portion of the wafer W is positioned relative to the inner circumferential portion of the workpiece holder H in the above-described manner, the wafer is released from the workpiece holding mechanism.

At this time, if the lower polishing turn table 1 is wet, there arises a possibility of the wafer W floating on remaining liquid and coming out of the workpiece holder H. In order to eliminate such a possibility, fluid such as air is jetted for about one second before the wafer W is released from the workpiece holding mechanism in order to remove the remaining liquid, to thereby allow the wafer W to be reliably held in the workpiece holder H.

Preferably, the depth of the holder H is as small as about 0.5 mm.

After the wafer W has been set into the workpiece holder H, the robot arm sucks and holds a next wafer W at the alignment stage 16 and transports and sets the next wafer W into a different workpiece holder H in the same carrier C. This operation is repeated so that the wafers W are placed into all of the three workpiece holders H. Upon completion of this operation, setting wafers W onto the next carrier C is performed.

That is, after issuance of a command for returning the arm of the transport robot 8 to the wait position, the computer 7 outputs a carrier moving command to the polishing machine, so that a new carrier C is positioned. After this sequential operation has been performed to the number of times corresponding to the number of the carriers C, a machining start command is issued to the polishing machine.

Next, there will be described an operation of unloading machined wafers W.

After the upper polishing turn table 4 has been retracted upon completion of machining, the carrier C is stopped at a predetermined position in the same manner as described above. Subsequently, the positions of the wafer W are determined based on the image recognition data from the visual sensor 6, and a moving command is outputted to the transport robot 8.

At this time, the outputted moving command is such that the workpiece holding mechanism of the transport robot 8 does not move toward the center position of the wafer W obtained by means of image processing, but moves to a position offset from the center position by a predetermined distance that has been previously set. Thus, the workpiece holding mechanism sucks and holds the wafer W at a position offset from the center thereof.

This offset positioning is performed for the following reason. After being machined, a wafer W strongly adheres to the top surface of the lower polishing turn table 1, due to surface tension of polishing solution or the like used during machining. Therefore, the wafer W cannot be removed with a weak force unless the wafer W is lifted in a state in which a portion eccentric from the center portion is sucked.

The thus-removed wafer W is transported to a position above the slope 17 and then released, so that the wafer W is led into the workpiece collecting bath 20.

When all the wafers W are taken out of the carrier C through repetition of the above-described operation, the transport robot 8 is temporarily moved to the wait position. After the next carrier C is positioned at a predetermined position, the same operation is repeated, so that all the wafers W are unloaded.

By virtue of the above-described method, the operation of loading and unloading wafers into and from the polishing machine can be automated completely, and can be performed precisely.

The present invention is not limited to the above-described embodiments. The above-described embodiments are mere examples, and those having the substantially same structure as that described in the appended claims and providing the similar action and effects are included in the scope of the present invention.

For example, in the above-described embodiment, wafers W are transported one piece at a time through use of the transport robot 8. However, a plurality of wafers W of each carrier C may be transported together.

Further, a plurality of transport robots 8 may be disposed; the number of the carriers C and the number of the workpiece holders H may be determined freely; and no limitation is imposed on the method by which the workpiece holding mechanism 21 sucks the wafer W.

What is claimed is:

1. An automatic workpiece transport apparatus for loading and unloading workpieces into and from workpiece holders of workpiece holding carriers, comprising:

a positioning device having a position sensor and moving mechanism for positioning the carrier at a predetermined position;

a visual sensor for optically recognizing a workpiece holding surface of the positioned carrier and for outputting image recognition data; and a control device for image-processing the image recognition data in order to determine the positions of the workpiece holders or the workpieces and for controlling the position of a robot arm having a workpiece holding mechanism on the basis of the determined positions of the workpiece holders or the workpieces, wherein the robot arm for workpiece transport has at least two visual sensors that optically recognize the peripheral portion of a workpiece held by the robot arm and output image recognition data to the control device.

2. An automatic workpiece transport apparatus according to claim 1, wherein the carrier has a reference mark that is provided in at least two locations and is used as a reference when the positions of the workpiece holders or workpieces are determined on the basis of the image recognition data.

3. An automatic workpiece transport apparatus according to claim 1, wherein when the robot arm is controlled by the control means in order to remove the workpiece from the workpiece holder, the control is performed such that a workpiece holding mechanism of the robot arm holds the workpiece at a position offset from the center of the workpiece.

4. An automatic workpiece transport apparatus according to claim 2, wherein when the robot arm is controlled by the control means in order to remove the workpiece from the workpiece holder, the control is performed such that a workpiece holding mechanism of the robot arm holds the workpiece at a position offset from the center of the workpiece.

5. The automatic workpiece transport apparatus of claim 1, wherein the workpiece holders hold the workpiece for polishing both sides of the workpiece.

* * * * *